US007063361B1

(12) United States Patent
Lawrence

(10) Patent No.: US 7,063,361 B1
(45) Date of Patent: Jun. 20, 2006

(54) LOCKING WINDOW

(76) Inventor: Barry Gene Lawrence, 1515 Johnsontown Rd., Thomasville, NC (US) 27360

( * ) Notice: Subject to any disclaimer, the term of this patent is extended or adjusted under 35 U.S.C. 154(b) by 0 days.

(21) Appl. No.: 10/158,405

(22) Filed: May 30, 2002

(51) Int. Cl.
*E05C 3/04* (2006.01)

(52) U.S. Cl. ..... 292/241; 292/DIG. 47

(58) Field of Classification Search ..... 292/240, 292/241, 242, DIG. 20, DIG. 47
See application file for complete search history.

(56) References Cited

U.S. PATENT DOCUMENTS

| | | | | | |
|---|---|---|---|---|---|
| 229,894 | A | * | 7/1880 | Kolb | 292/67 |
| 907,525 | A | | 12/1908 | Rapson | |
| 949,862 | A | * | 2/1910 | Tower | 292/228 |
| 1,950,311 | A | | 3/1934 | Leghart | 189/66 |
| 2,613,526 | A | * | 10/1952 | Holmsten | 70/90 |
| 3,125,923 | A | | 3/1964 | Hanneman | 85/47 |
| 3,645,573 | A | * | 2/1972 | Strang | 292/241 |
| 4,036,039 | A | * | 7/1977 | Nakanishi | 70/90 |
| 4,061,370 | A | | 12/1977 | Hauber | 292/175 |
| 4,093,285 | A | | 6/1978 | Fayle | 292/251 |
| 4,095,829 | A | | 6/1978 | Van Klompenburg | 292/241 |
| 4,135,773 | A | | 1/1979 | Van Remoortel | 308/238 |
| D268,643 | S | | 4/1983 | Anderson | D6/337 |
| 4,436,328 | A | | 3/1984 | Chernosky | 292/67 |
| 4,443,032 | A | * | 4/1984 | Bonassi | 292/202 |
| 4,578,903 | A | | 4/1986 | Simpson | 49/175 |
| 4,683,731 | A | * | 8/1987 | Wickman | 70/69 |
| 4,736,972 | A | | 4/1988 | Mosch | 292/204 |
| 4,763,497 | A | | 8/1988 | Nakai | 70/95 |
| 4,790,579 | A | | 12/1988 | Maxwell et al. | 292/175 |
| 4,801,164 | A | * | 1/1989 | Mosch | 292/204 |
| 4,813,725 | A | | 3/1989 | Mosch | 292/241 |
| 4,818,000 | A | | 4/1989 | Bobrowski | 292/147 |
| D302,651 | S | | 8/1989 | Mosch | D8/337 |
| 5,040,835 | A | | 8/1991 | Barker | 292/338 |
| 5,060,993 | A | | 10/1991 | Maier | 292/241 |
| 5,103,533 | A | | 4/1992 | Pettit et al. | 16/342 |
| 5,161,839 | A | * | 11/1992 | Piltingsrud | 292/241 |
| 5,219,195 | A | | 6/1993 | Lawrence | 292/336.3 |
| 5,248,174 | A | | 9/1993 | Matz et al. | 292/338 |
| 5,301,989 | A | | 4/1994 | Dallmann et al. | 292/142 |
| 5,414,899 | A | | 5/1995 | Raetz | 16/380 |
| 5,489,131 | A | | 2/1996 | Blom | 292/101 |
| D369,741 | S | | 5/1996 | Harrison et al. | D8/400 |
| D380,957 | S | | 7/1997 | Evans et al. | D8/337 |
| D382,191 | S | | 8/1997 | Plummer | D8/337 |
| D386,384 | S | | 11/1997 | Rausch et al. | D8/330 |
| 5,741,032 | A | * | 4/1998 | Chaput | 292/202 |

(Continued)

*Primary Examiner*—Gary Estremsky
(74) *Attorney, Agent, or Firm*—MacCord Mason PLLC

(57) ABSTRACT

A locking window having a window frame and a window latch for use with the window is disclosed. The window latch, which is adapted to be attached to the window using a distinct fastener, is selectively movable between a first open position and a second locked position to secure the window sash in the closed position. The window latch includes an actuator arm, a locking arm, a non-compressible pivot and a housing. A pivot location is situated at the union of the actuator arm and the locking arm. The pivot location permits the actuator arm and the locking arm to be selectively movable between a first closed position and a second open position. The housing may include a securing feature for maintaining the housing substantially set relative to the window while at the same time permitting the actuator arm and the locking arm to be selectively movable between a first closed position and a second open position.

36 Claims, 8 Drawing Sheets

U.S. PATENT DOCUMENTS 5,791,700 A 8/1998 Biro ..... 292/7
5,839,767 A 11/1998 Piltingsrud ..... 292/336.3
D418,737 S 1/2000 Libby et al. ..... D8/337
6,010,094 A * 1/2000 Csik et al. ..... 244/129.1
6,068,306 A 5/2000 Brautigam ..... 292/242
6,116,665 A 9/2000 Subliskey ..... 292/241
D432,392 S 10/2000 Miller et al. ..... D8/337
6,142,541 A * 11/2000 Rotondi ..... 292/241
D442,058 S 5/2001 Miller et al. ..... D8/337
6,347,820 B1 2/2002 Subliskey ..... 292/346
6,412,834 B1 7/2002 Waitai et al. ..... 292/197
6,457,752 B1 10/2002 Miller et al. ..... 292/202
6,598,910 B1 * 7/2003 Mcgregor ..... 292/156

* cited by examiner

LOCKING WINDOW

BACKGROUND OF THE INVENTION (1) Field of the Invention

The present invention relates generally to a locking window and, more particularly, to a window latch for such a window.

(2) Description of the Prior Art

Up to the end of World War II, most windows were constructed of wood. However, following the War, aluminum windows were initially constructed for low-end housing. Over time, the clear superiority of metal windows led to their use in many different types of housing. Similarly, vinyl windows were introduced in low-end housing in the beginning of the last decade. The use of vinyl windows has grown much more quickly than metal windows. In fact, the majority of windows are now constructed using vinyl.

During this time, locking windows have generally used metal latches similar to those that were initially used on wooden windows. Now, although vinyl windows are the predominant construction, there has still been a hesitancy to use plastic hardware. However, metal is much heavier than its corresponding plastic counterpart. Also, plastic retains its appearance when mishandled or otherwise misused that would causes unacceptable chips to form on painted metal hardware. Also, in today's global economy, window hardware may be made in another country. Accordingly, advantages of substantial weight savings to create lower shipping costs have become even more important.

However, making a locking window having a plastic latch is more than a mere substitution of materials. Because plastic is generally more flexible than metal, attempts at constructing a window latch have failed since there's not a sufficient amount of support to prevent bowing. The significance of bowing relates primarily due to the requirement that a latch be able to maintain a static load of about 160 pounds. When a conventional latch design is formed from plastics, the bowing of the latch is so substantial that the static load will actually slide off the latch arm. Because of this problem, such plastic window latches having conventional designs have not been able to pass the static load test.

Also, the labor cost for attaching a latch to a window affects the overall cost of a locking window. One factor affecting this cost is the number of fasteners required for attaching a latch to a window. Another factor is the alignment of the window latch on the window. However, reducing the number of fasteners introduces undesirable and unacceptable play of the latch during opening and closing while at the same time making alignment more difficult. The increased difficultly of alignment rather than decreasing cost, increases cost since properly aligning the latch during attachment involves more time.

Thus, there remains a need for a new and improved locking window having a window latch which may be completely formed from chip resistant plastics while, at the same time, still provides sufficient firmness due to its arrangement to resist normal wear and tear during assembly and use.

SUMMARY OF THE INVENTION

The present invention is directed to a locking window having a window frame and a window latch for use with the window. The window frame includes at least one window sash that is selectively movable between a first closed position and a second open position. The window latch, which is adapted to be attached to the window using a distinct fastener, is selectively movable between a first open position and a second locked position to secure the window sash in the closed position. The window latch includes an actuator arm, a locking arm, a non-compressible pivot and a housing. A pivot location is situated at the union of the actuator arm and the locking arm. The pivot location permits the actuator arm and the locking arm to be selectively movable between a first closed position and a second open position. The housing may include a securing feature for maintaining the housing substantially set relative to the window while at the same time permitting the actuator arm and the locking arm to be selectively movable between a first closed position and a second open position.

An example of a securing feature is a lip (e.g., extending beyond a bottom of the housing) adapted to engage the window to ensure alignment. An example of a distinct fastener is a threaded fastener. An example of a non-compressible pivot is a support bushing. A non-compressible pivot may further include a lower load-bearing surface. Alternatively, the non-compressible pivot may be an inverted bushing. In any case, a non-compressible pivot may include an aperture through which the distinct fastener may pass to secure the latch to the window. Also, a non-compressible pivot prevents compression of the housing by the distinct fastener while at the same time permitting the actuator arm and the locking arm to be selectively movable between a first closed position and a second open position.

The window latch may further include a detent for retaining the latch in one of the open and the locked positions. The detent may have an element having a planar orientation and an additional element that interact with the planer element. Also, the detent may provide an audible click while transitioning to one of the open and the locked positions. The planer element of the detent may further include at least one groove on one of the housing and the sweep latch. The at least one grove may be a barbell shaped grove. Likewise, the additional element of the detent may further include at least one protrusion on the other of the housing and the sweep latch.

The window latch may further include a locking arm stop. The locking arm stop may prevent non-intentional movement. Also, the locking arm stop may hinder intentional attempted movement from the exterior.

The housing may further include any one of a finger well, a finger shoulder, an aperture for accepting the distinct fastener, a cover, and combinations thereof. The aperture for accepting the distinct fastener may further include a retainer for holding the distinct fastener in the window latch to facilitate an efficient positioning and securing of the window latch to the window. The cover may be used to conceal the distinct fastener after it has been secured to the window. To that end, the cover may be a screw cap. Also, the cover may include indicia to, for example, display a logo, brand name and the like. The inclusion of indicia on the cover allows the same latch design to be sold under a variety of brand names.

The window latch of the present invention may be any one of a cam latch, a sweep latch and an offset sweep latch. The window frame may be made of any one of wood, polymer and metal. The window sash may be any one of, a casement window, a single hung window, a double hung window including horizontally and vertically sliding sashes.

A window latch may include a strengthening web between the arms that may be in the form of a support wall. For a cam latch, the support wall may be between the locking arm and an end of the housing. For a sweep latch, the support wall may be offset to one side of the housing. Also with the cam latch and the sweep latch, a second wall may be included. For a sweep latch, the walls may be offset with respect to each other. The walls may be substantially perpendicular to the face. For an offset sweep latch, the housing may include a reinforcing shoulder. Also, for an offset sweep latch, the housing may have a distal end extending above the locking arm and the actuator arm.

A window latch may include a keeper. For a cam latch, the keeper may include any one of a cam detent for engagement by the locking arm and an aperture for facilitating the attachment of the keeper to the window. An aperture for attachment may further include a retainer for holding a fastener in the keeper to facilitate an efficient positioning and securing of the keeper to the window.

The pivot location of a window latch may include a key lock that facilitates the transmission of movement from an actuator arm to a locking arm. Further, the key lock may include an alignment feature that facilitates a rapid and consistent alignment of an actuator arm and a locking arm.

The locking arm of a window latch may include an inclined face that facilitates the transition between a first open position and a second locked position to secure the window sash in the closed position. A length of the locking arm is less than or equal to one half a length of the actuator arm. For a cam latch, the locking arm may include a cam wall for engaging the cam detent. The actuator arm may further include a finger tab.

In an embodiment according to the present invention, a window latch may include a keeper buttress that strengthens the keeper as it is engaged by the locking arm. In this manner the locking arm fixedly engages to the keeper even while external force is exerted on the window. The keeper buttress may be part of any one of the housing, the locking arm, and the actuator arm.

Accordingly, one aspect of the present invention is to provide a locking window having a window frame and a window latch for use with the window. The window frame includes at least one window sash that is selectively movable between a first closed position and a second open position. The window latch, which is adapted to be attached to the window using a distinct fastener, is selectively movable between a first open position and a second locked position to secure the window sash in the closed position. The window latch includes an actuator arm, a locking arm and a housing. A pivot location is situated at the union of the actuator arm and the locking arm. The pivot location permits the actuator arm and the locking arm to be selectively movable between a first closed position and a second open position.

Another aspect of the present invention is to provide a window latch for use with window having a window frame. The window frame includes at least one window sash that is selectively movable between a first closed position and a second open position. The window latch, which is adapted to be attached to the window using a distinct fastener, is selectively movable between a first open position and a second locked position to secure the window sash in the closed position. The window latch includes an actuator arm, a locking arm and a housing. A pivot location is situated at the union of the actuator arm and the locking arm. The pivot location permits the actuator arm and the locking arm to be selectively movable between a first closed position and a second open position. The housing includes a securing feature for maintaining the housing substantially set relative to the window while at the same time permitting the actuator arm and the locking arm to be selectively movable between a first closed position and a second open position.

Still another aspect of the present invention is to provide a locking window having a window frame and a window latch for use with the window. The window frame includes at least one window sash that is selectively movable between a first closed position and a second open position. The window latch, which is adapted to be attached to the window using a distinct fastener, is selectively movable between a first open position and a second locked position to secure the window sash in the closed position. The window latch includes an actuator arm, a locking arm, a non-compressible pivot and a housing. A pivot location is situated at the union of the actuator arm and the locking arm. The pivot location permits the actuator arm and the locking arm to be selectively movable between a first closed position and a second open position. The housing may include a securing feature for maintaining the housing substantially set relative to the window while at the same time permitting the actuator arm and the locking arm to be selectively movable between a first closed position and a second open position.

These and other aspects of the present invention will become apparent to those skilled in the art after a reading of the following description of the preferred embodiment when considered with the drawings.

DESCRIPTION OF THE PREFERRED EMBODIMENTS

Figure 1:
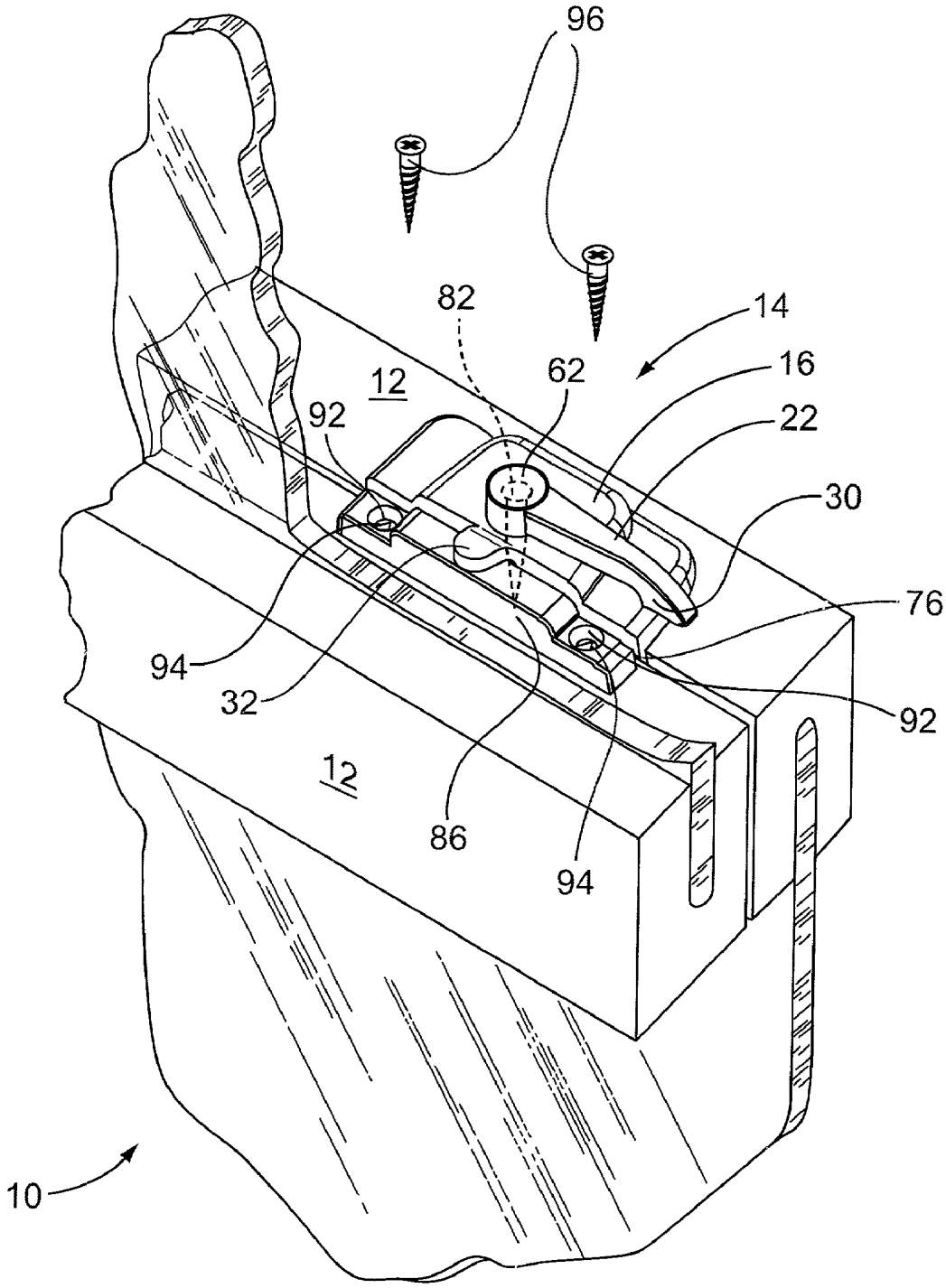
FIG. 1 is a perspective view of a locking window constructed according to an aspect of an embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 5:
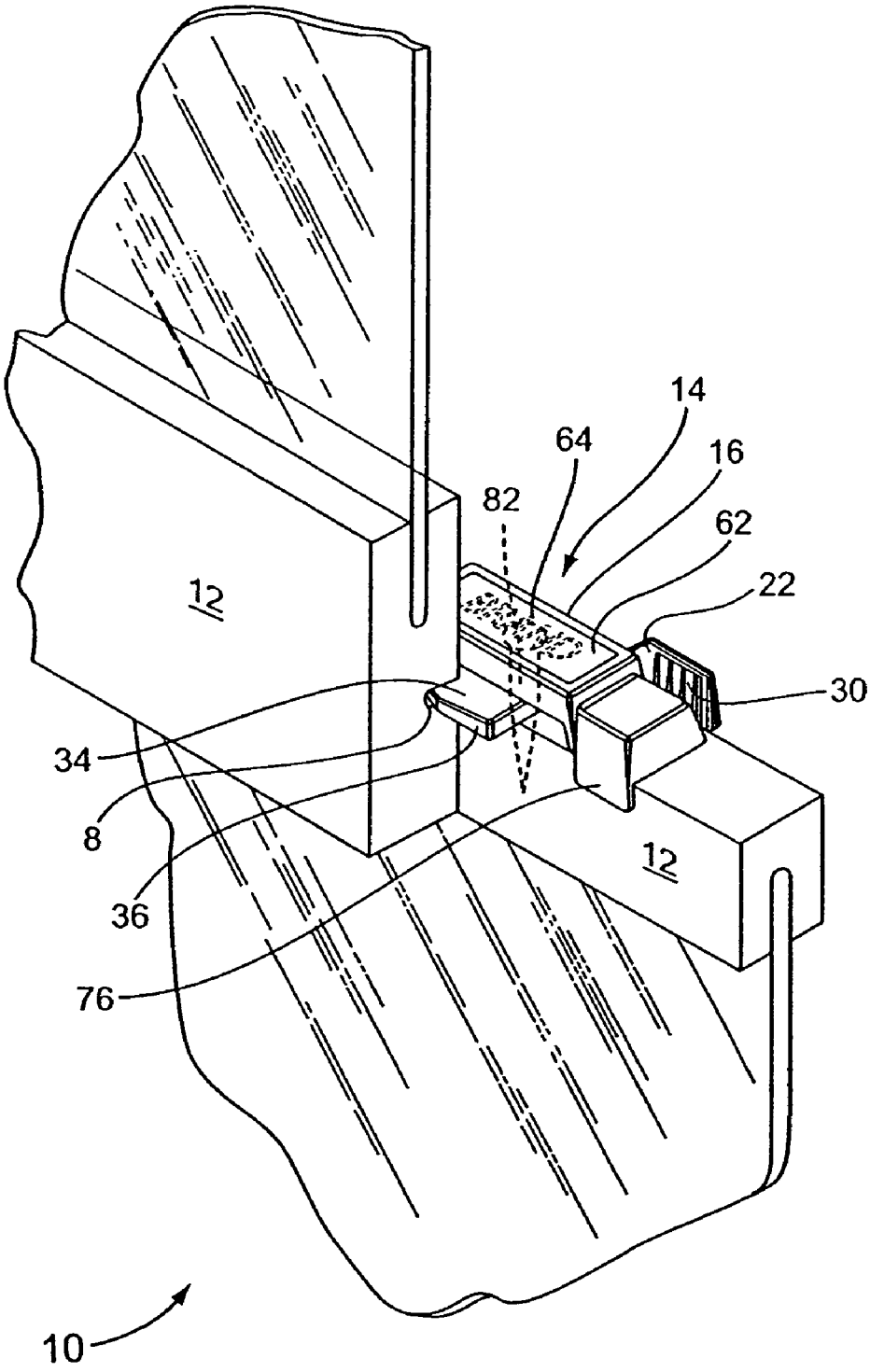
FIG. 5 is a perspective view of a locking window constructed according to an aspect of an embodiment of the present invention.
Figure 7:
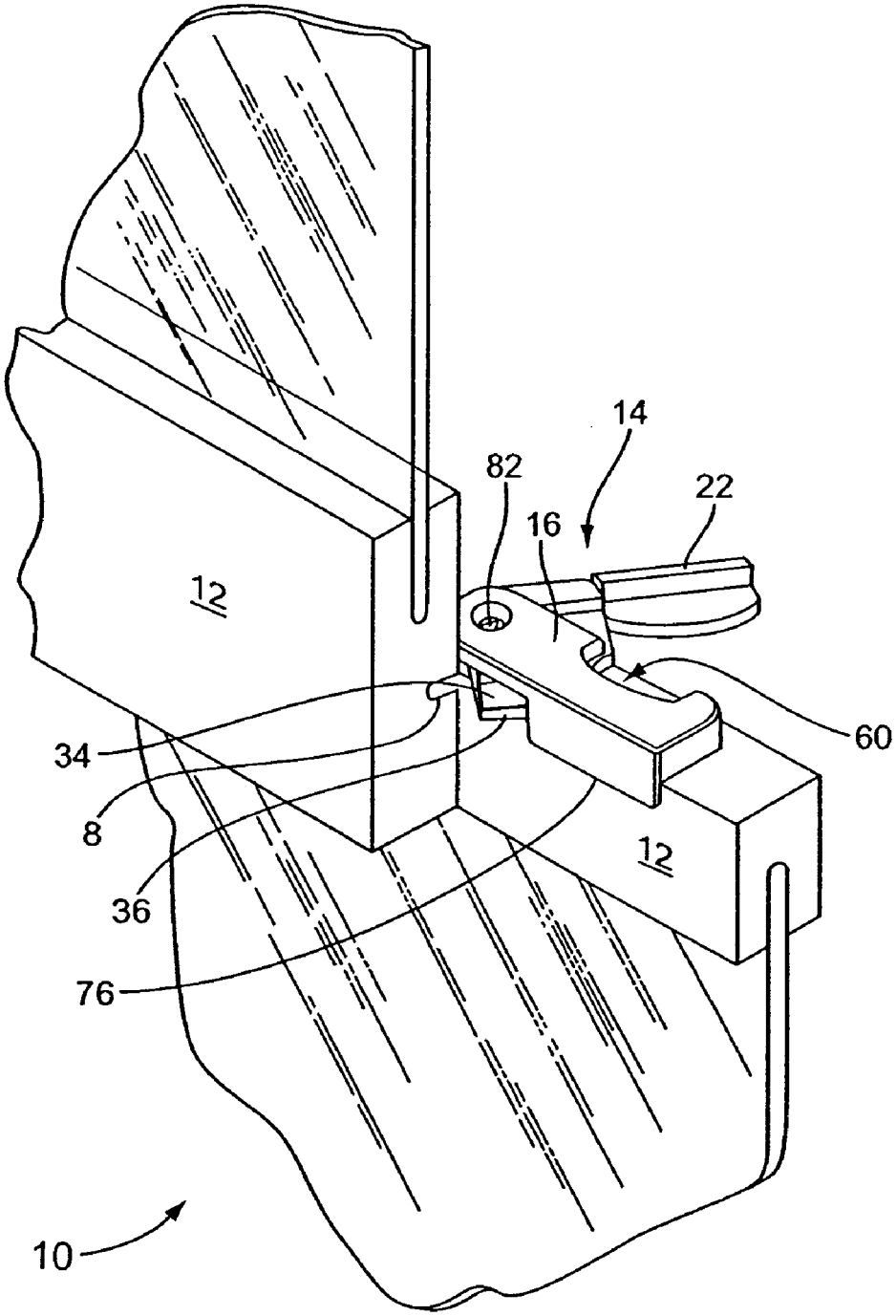
FIG. 7 is a perspective view of a locking window construction according to an aspect of an embodiment of the present invention.
Figure 8:
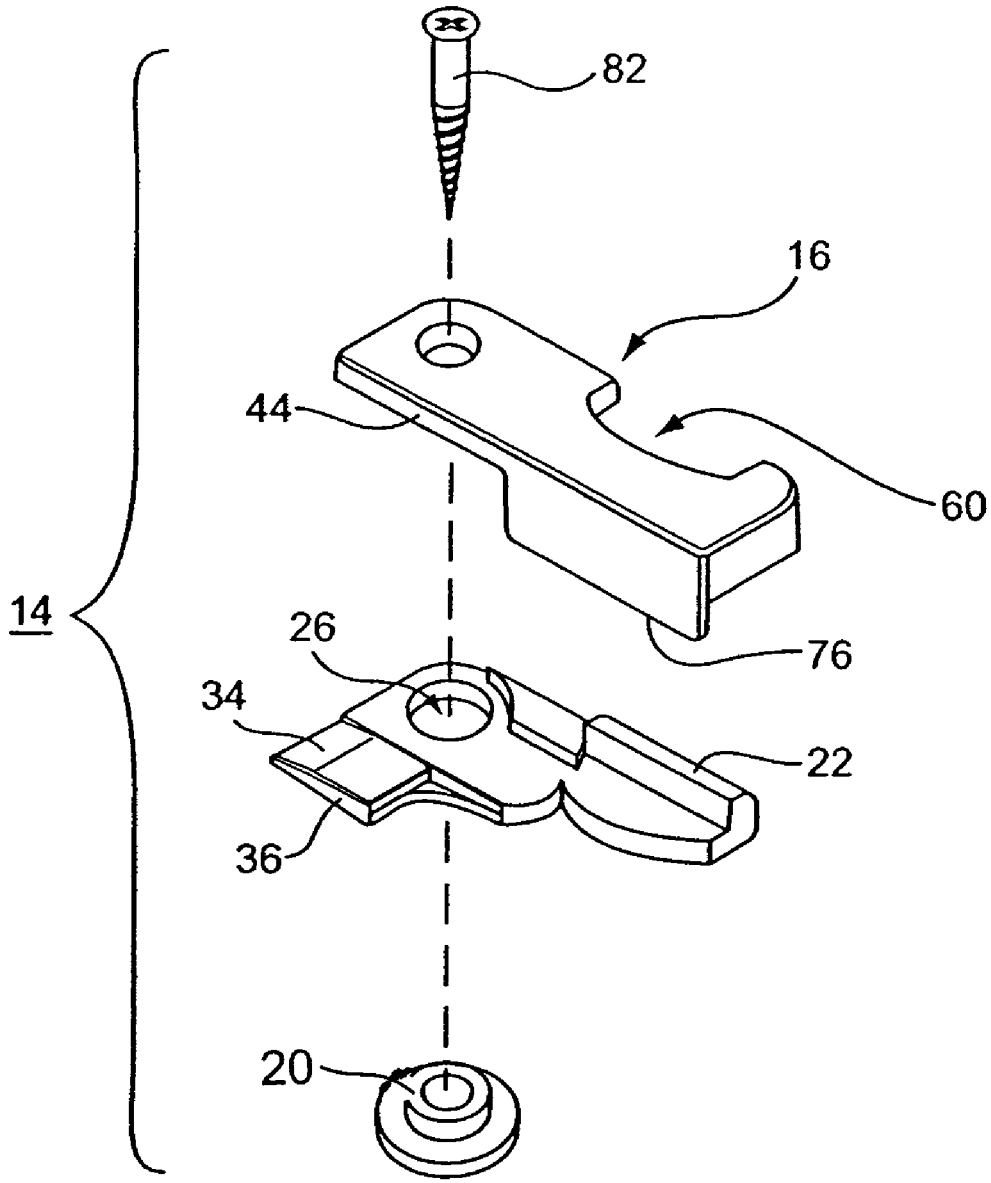
FIG. 8 is an isometric top exploded view of an alternative window latch of the locking window shown in FIG. 7.

Referring now to the drawings in general and FIG. 1, FIG. 5 and FIG. 7 in particular, it will be understood that the illustrations are for the purpose of describing a preferred embodiment of the invention and an aspect of the preferred embodiment, and are not intended to limit the invention thereto. As best seen in FIG. 1, FIG. 5 and FIG. 7, a window, generally designated 10, is shown constructed according to the present invention. The window 10 includes window frame 12 and a window latch 14 fastenable to the window 10 with a distinct fastener 82. As best seen in FIG. 1, FIG. 5 and FIG. 7, any of a number of window latch designs are contemplated in the present invention such as, for example, a cam latch, a sweep latch, an offset sweep latch and the like. To that end, a window latch 14 fastenable to the window 10 with a distinct fastener 82 may generally include a housing 16, an actuator arm 22, a locking arm 36 and a pivot location 26. The pivot location 26 is situated at the union of the actuator arm 22 and the locking arm 36. The actuator arm 22 may further include a finger tab 30 to facilitate the opening and closing of the window latch 14. The locking arm 36 may further include an inclined face 34.

As best seen in FIGS. 1–4D, the window latch 14 may be a cam latch. In this case, the locking arm includes a cam wall 40 including an inclined face 34. As best seen in FIGS. 5–8, the window latch 14 may be a sweep latch having an inclined face 34. In either case, a length of the locking arm 36 is one of less than about one half a length of the actuator arm 22 and about equal to one half a length of the actuator arm 22. This relation provides a mechanical advantage to a user while pivoting about the pivot location 26.

Figure 2A:
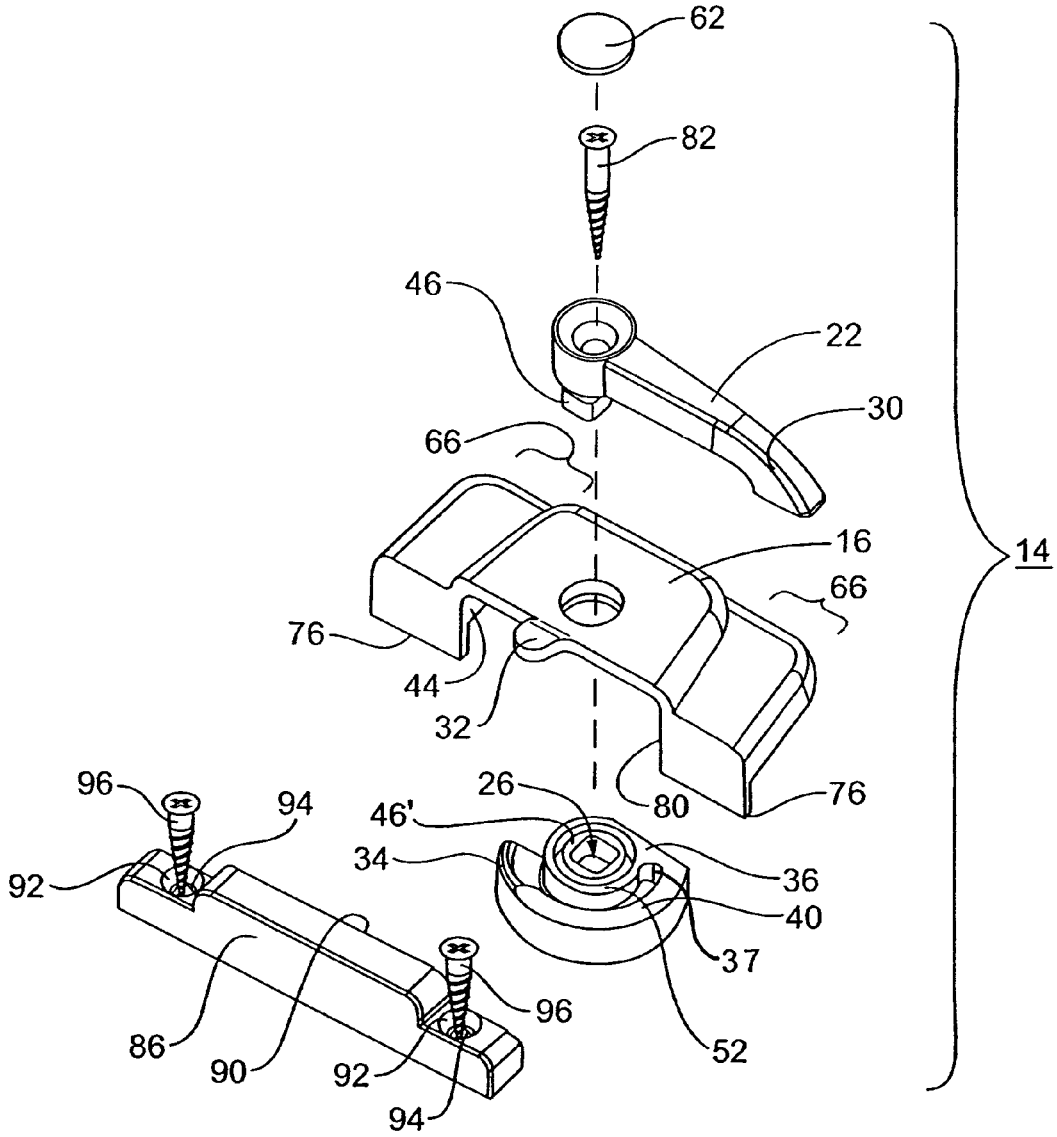
FIG. 2A is an isometric top exploded view of a window latch of the locking window shown in FIG. 1.
Figure 2B:
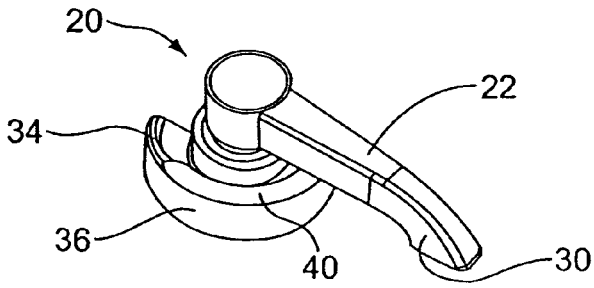
FIG. 2B is an isometric top view of the arm of FIG. 2A.
Figure 3A:
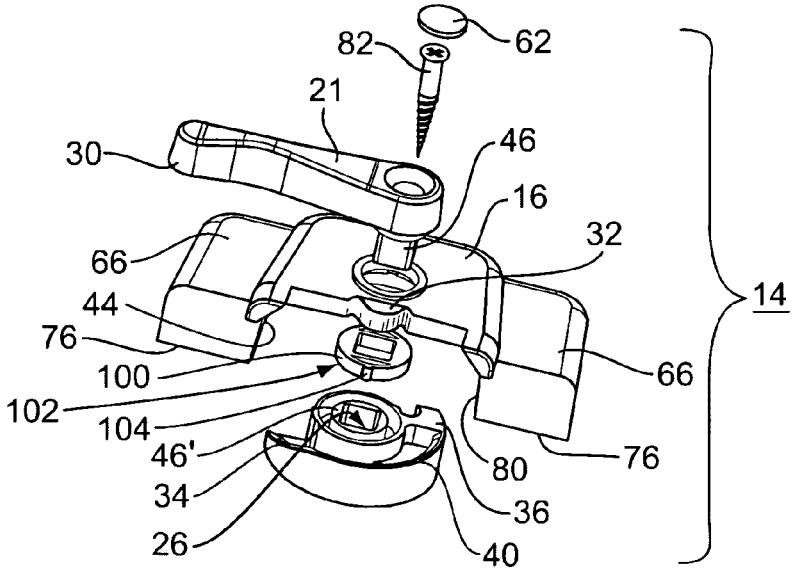
FIG. 3A is an isometric top exploded view of an alternative window latch of the locking window shown in FIG. 1.
Figure 3B:
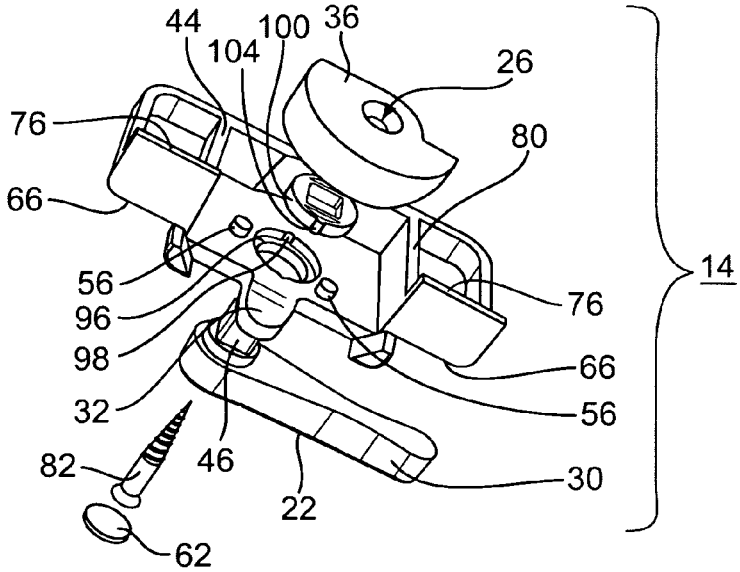
FIG. 3B is a bottom exploded view of the window latch shown in FIG. 3A.
Figure 3C:
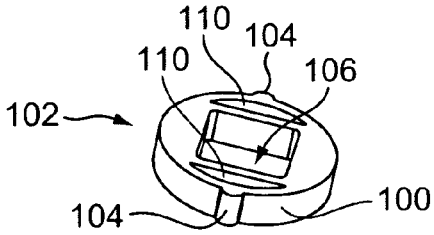
FIG. 3C is a detail of a component of the window latches of FIG. 3A and FIG. 3B.
Figure 4A:
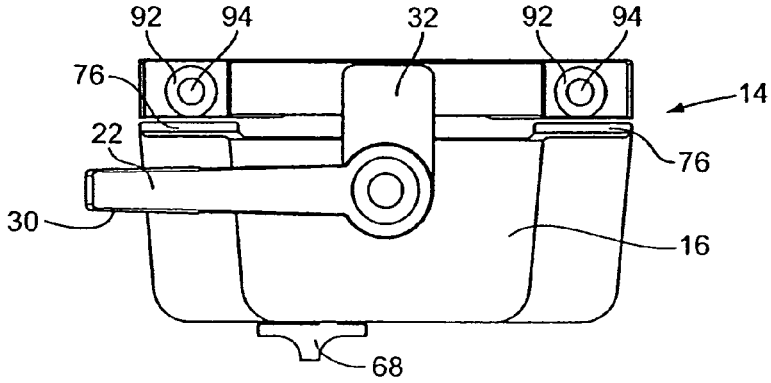
FIG. 4A is a top view of a stop according to an aspect of an embodiment of the present invention.
Figure 4B:
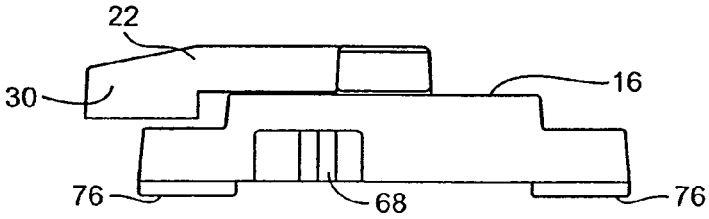
FIG. 4B is a front view of the stop of FIG. 4B.
Figure 4C:
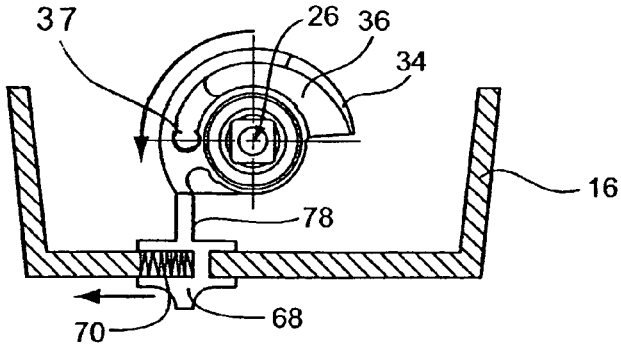
FIG. 4C is a top cross-sectional view of the stop of FIG. 4A and FIG. 4B in the locking arm movement inhibiting position.
Figure 4D:
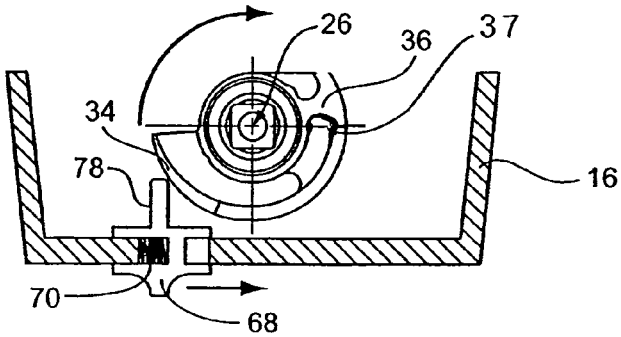
FIG. 4D is a top cross-sectional view of the stop of FIG. 4A and FIG. 4B in the locking arm movement non-inhibiting position.

As best seen in FIG. 2A, FIG. 3A, and FIG. 3B, the pivot location 26 also may include a key lock 46 to effectively transfer the movement of the actuator arm 22 to the locking arm 36. In addition, the key lock 46 may include an alignment feature 50 to facilitate consistent relative alignment of the actuator arm 22 and the locking arm 36.

A window latch 14 fastenable to the distinct fastener 82 to the window 10 may include a housing 16. Depending on the particular type of window latch, the housing 16 may include a variety of features. For example, when the housing 16 is associated with an offset sweep latch the housing 16 may further include a finger well 60. Alternatively, when the housing 16 is associated with a sweep latch or a cam latch, the housing 16 may further include a finger shoulder 66. No matter the type of latch, the housing 16 may include a cover 62 that, optionally, may include indicia 64.

As best seen in FIG. 1, FIG. 2A, FIG. 3A, FIG. 3B, FIG. 4B, FIG. 5, FIG. 6, FIG. 7, and FIG. 8, the housing may include a securing feature 78 for maintaining the housing substantially set relative to the window frame 12 while at the same time permitting the actuator arm 22 and the locking arm 36 to be selectively movable between a first closed position and a second open position. An example of a securing feature is a lip (e.g., extending beyond a bottom of the housing) adapted to engage the window to ensure alignment.

As best seen in FIGS. 4A–4D, a window latch 14 further may include a locking arm stop 70. Such a stop 70 may be used to prevent non-intentional movement of a locking arm 36 such as by a brushing of one's shoulder up against a window latch 14 (e.g., against an actuator arm 22 or a locking arm 36). Further, the locking arm stop 70 hinders intentional movement from external attempts including an attempted break such as by jimmying the window 10 or window latch 14.

Figure 6:
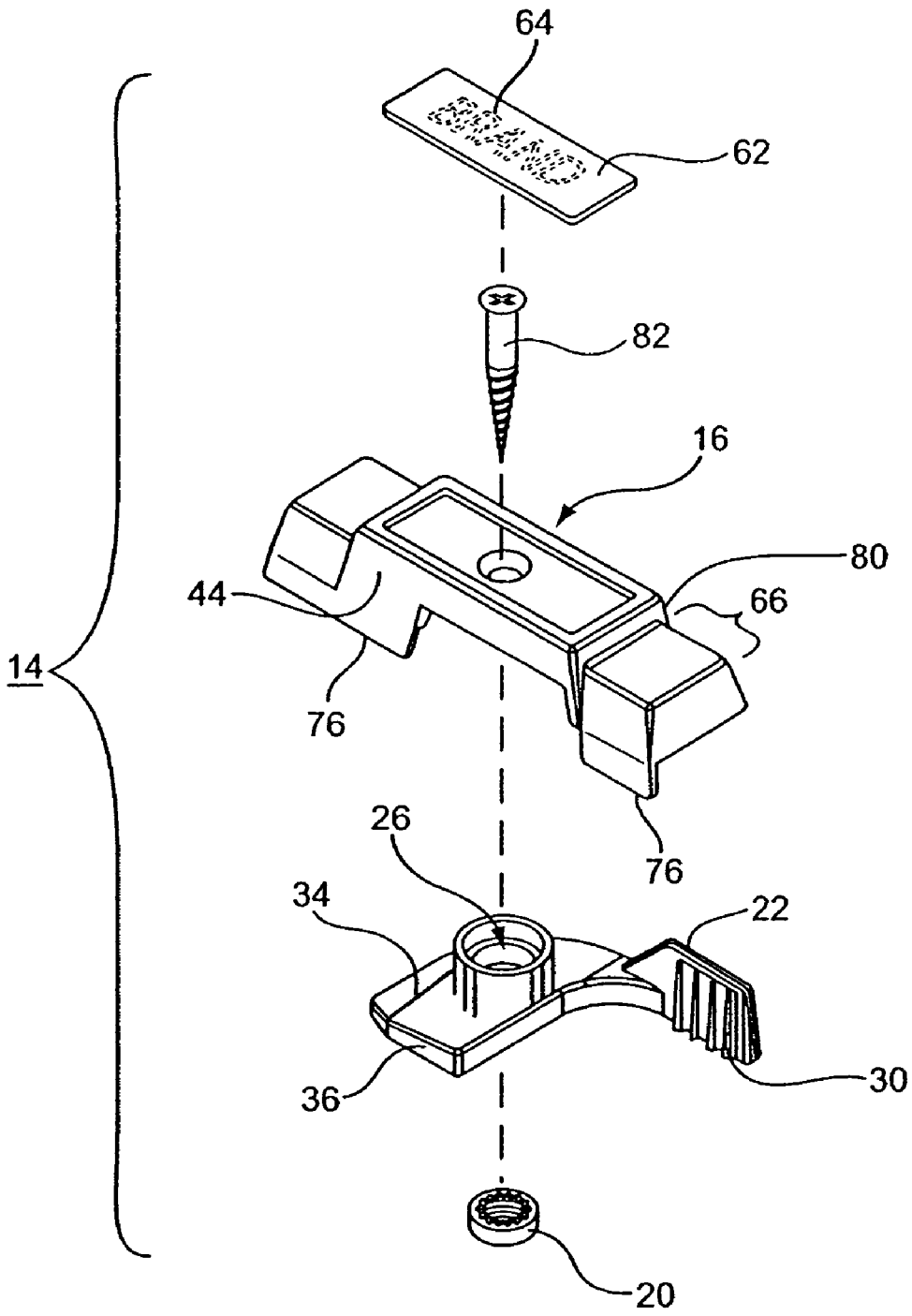
FIG. 6 is an isometric top exploded view of the window latch of the locking window of FIG. 5.

A window latch 14 may include a strengthening web between the arms that may be in the form of a support wall 44. As best seen in FIG. 3B, for a cam latch the support wall 44 may be between the locking arm 22 and an end of the housing 16. As best seen in FIG. 6, for a sweep latch the support wall 44 may be offset to one side of the housing 16. Also with the cam latch and the sweep latch, a second wall 80 may be included. As best seen in FIG. 6, for a sweep latch the walls may be offset with respect to each other. The support wall 44 and the second wall 80 may be substantially perpendicular to the face. As best seen in FIG. 6, for an offset sweep latch the housing 16 may include a reinforcing shoulder 66. Also for an offset sweep latch, the housing 16 may have a distal end extending above the actuator arm 22 and the locking arm 36.

The window latch 14 may include a keeper 86 in such instances when the window latch is a cam latch. The keeper 86 would further include a cam detent 90 and an aperture 92 for attachment that may also include a retainer 94.

In the case that the latch includes a keeper 86, the housing 16 may further include a keeper buttress 32. It has been found that the keeper 86 tends to bow when engaged by the locking arm 36 and it is beneficial to have a keeper buttress 32 to prevent its deflection and upward movement.

As best seen in FIG. 1, FIG. 2A, FIG. 3A, FIG. 3B, and FIG. 4A, a window latch 14 may include a keeper buttress 32 that strengthens the keeper 86 as it is engaged by the locking arm 36. In this manner, the locking arm 36 may fixedly engage the keeper 86 even while external force is exerted on the window. The keeper buttress 32 may be part of any one of the housing, the locking arm, and the actuator arm.

Each of the window latches 14, according to the present invention, includes a non-compressible pivot 20. The non-compressible pivot 20 allows the fastening of the window latch to the frame while facilitating its smooth operation. The non-compressible pivot 20 may include a fastener 82 that, for example, might be a threaded fastener. The non-compressible pivot 20 may be a support bushing or an inverted bushing. It may further include a lower bearing surface.

The operation of a locking window having an offset sweep is discussed in U.S. application Ser. No. 09/489,489; filed Jan. 21, 2000, in the names of Miller et al. The operation of a locking window having a cam is discussed in U.S. application Ser. No. 09/922,577; filed Aug. 3, 2001, in the names of Miller et al. The operation of a locking window having a sweep is discussed in U.S. application Ser. No. 09/908,418; filed Jul. 18, 2001, in the names of Miller et al. Each disclosure of these applications is hereby incorporated herein in its entirety.

The operation of a locking window 10 having a window frame 12 and a window latch 14 for use with the window has been discussed above. It is noteworthy that the window latch 14 is adapted to be attached to the window frame 14 using a distinct fastener 82. Also noteworthy is that the housing 16 may include a securing feature 76 for maintaining the housing 16 substantially set relative to the window frame 14 while at the same time permitting the actuator arm and the locking arm to be selectively movable between a first closed position and a second open position. Further, it is noteworthy that a window latch 14 may include a keeper buttress 32 that strengthens the keeper 86 as it is engaged by the locking arm 36. In this manner the locking arm 36 may fixedly engage the keeper 86 even while external force are exerted on the window. The keeper buttress 32 may be part of any one of the housing, the locking arm, and the actuator arm.

The window latch 14 may be formed from any lightweight durable material, such as a lightweight metal including aluminum, or a polymeric material. Applicants contemplate that suitable materials may be characterized by at least one of high strength, high rigidity, very good impact resistance, good elastic properties, dimensional stability, low tendency to creep, and simple processing. Preferably, suitable materials may be characterized by a plurality of the above. Applicants have found that among polymeric materials, polyamides (also known as nylons) work well and believe that polyamides including a filler may work well. In the preferred embodiment, the material used to form the window latch 14 was made using commercially available polyamides such as the "ULTRAMID®" polyamide sold by BASF Corporation of Mount Olive, N.J. These ULTRAMID®" polyamide materials, their applications, properties and processing as described in a publication by BASF Plastics entitled "ULTRAMID®" Polyamides, the subject mater of which is incorporated in its entirety herein by reference.

For wear resistance, applicants contemplate that a semi-crystalline Nylon 6 (PA6) containing about 30 percent glass fiber may work. One such material is manufactured by Hughes Supply & Manufacturing Company of Thomasville, Inc., of Thomasville, N.C. under the trademark "FIBERTRON™" material and has the properties presented below in Table 1.

TABLE 1

FIBERTRON ™ MATERIAL

| | | | |
|---|---|---|---|
| Description: | Semi-crystalline Nylon 6 (PA6) | | |
| Filler System: | 33% Glass Fiber | | |
| Characteristics: | Near Prime | | |
| PROPERTY | UNITS | TYPICAL VALUES | STANDARD |
| | General | | |
| Density | g/cm3 | 1.42 | ASTM D792 |
| Melt Flow Index | g/10 min. | — | ASTM D1238 |
| Water Absorption | % | — | ASTM D570 |
| Mold Shrinkage | in/in | 0.002–0.004 | ASTM D955 |
| | Mechanical | | |
| Tensile Strength (break) | psi | 19,500 | ASTM D638 |
| Elongation (break) | % | 3.2 | ASTM D638 |
| Flexural Strength (yield) | psi | 29,750 | ASTM D790 |
| Flexural Modulus | psi | 1,250,000 | ASTM D790 |
| Impact Strength (Izod-notched) | ft-lb/in | 3.3 | ASTM D256 |
| | Thermal | | |
| Heat Deflection Temperature (264 psi) | F | — | ASTM D648 |
| Vicat Softening Temperature | F | — | ASTM D1525 |
| | Flammability | | |
| UL Flammability Rating | Class | — | UL 94 |

The "FIBERTRON™" material may be made using commercially available polyamides such as the "ULTRAMID®" polyamide sold by BASF Corporation of Mount Olive, N.J. These ULTRAMID®" polyamide materials, their applications, properties and processing as described in a publication by BASF Plastics entitled "ULTRAMID®" Polyamides, the subject mater of which is incorporated in its entirety herein by reference.

As may be appreciated by those skilled in the art, a window and window latch constructed according to the present invention may be substantially completely formed from plastics while at the same time still provide sufficient strength due to their arrangement to resist normal wear and tear during assembly and use.

Table 2 contains a summary of a comparison of the window integrity, the ease of use of the window, and the product of the previous two. This comparison is for windows including a longitudinal window latch (i.e., depth to length ratio from about less than 1 to substantially less than 1), and the present invention. Window integrity may be defined as the ability of a window to have initially, and continue to have after repeated operation, for example, one or more of wind resistance, strength, and sealabilty. Ease of use may be defined as the ability of a window to have initially, and continue to have after repeated operation, for example, one or more of fluid pivoting and sliding movement without binding. As noted below in Table 2, 1 means that the window performs poorly, 2 means that the window performs poorly to neutrally, 3 means that the window performs neutrally, 4 means that the window performs neutrally to excellently, and 5 means that the window performs excellently.

TABLE 2

Comparison of Windows of the Prior Art and the Present Invention

| | Window Integrity | Ease of Use | (Integrity) × (Ease of Use) |
|---|---|---|---|
| Longitudinal Window latch | 2 | 3 | 6 |
| Present Invention | 4 | 4 | 16 |

1 = poor
2 = poor to neutral
3 = neutral
4 = neutral to excellent
5 = excellent

The window of the present invention is superior having an overall rating {(Integrity)×(Ease of Use)}of 16 verses 6 for the prior art. One reason for this superiority comes from the prior latch (See e.g., U.S. Pat. No. 5,139,291) having a tendency for twisting and popping out of the sash rail when force is exerted on the sash rail directly or through a wind pane contained within the sash.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A locking window comprising:

(a) a window frame including at least one window sash having a top surface connected to a side surface; and (b) a window latch coupled to said top surface of said window sash with only one fastener, said window latch including:

(i) an actuator arm connected to a locking arm;

(ii) a pivot location at a union of said locking arm and said actuator arm through which said fastener extends; and (iii) a housing at least partially enclosing said locking arm comprising: a lip extending downwardly from a bottom of said housing alongside said side surface to a position below said top surface of said sash to limit movement of said housing with respect to said window sash; and an opening through which said fastener extends.

2. The locking window according to claim 1, wherein said fastener is a threaded fastener.

3. The locking window according to claim 1, wherein said housing further includes a finger well.

4. The locking window according to claim 1, wherein said housing further includes a finger shoulder.

5. The locking window according to claim 1, wherein said housing further includes a cover.

6. The locking window according to claim 5, wherein said cover is a screw cap.

7. The locking window according to claim 5, wherein said cover is a nameplate.

8. The locking window according to claim 1, wherein said housing further includes a support wall.

9. The locking window according to claim 1, further including a keeper.

10. The locking window according to claim 1, wherein said locking arm further includes an inclined face.

11. The locking window according to claim 10, further including a cam wall.

12. The locking window according to claim 1, wherein said window latch is an offset sweep latch.

13. The locking window according to claim 12, further including a reinforcing shoulder.

14. The locking window according to claim 13, further including a strengthening web between the arms.

15. The locking window according to claim 1, wherein said actuator arm further includes a finger tab.

16. The locking window according to claim 1, wherein said actuator arm further includes a keeper buttress.

17. The locking window according to claim 1, wherein said window latch is a cam latch.

18. The locking window according to claim 1, wherein said window latch is a sweep latch.

19. A window latch for a locking window having a window frame including at least one window sash having a top surface connected to a side surface, the latch for coupling to the top surface of the window sash with only one fastener and comprising:

(a) an actuator arm connected to a locking arm;

(b) a pivot location at a union of said locking arm and said actuator arm through which a fastener extends; and (c) a housing at least partially enclosing said locking arm comprising: a lip extending downwardly from a bottom of said housing to reside alongside the side surface and extend to a position below the top surface of the sash to limit movement of said housing with respect to the sash; and only one opening for receiving said fastener to couple said latch to the sash.

20. The window latch according to claim 19, wherein said housing further includes a finger well.

21. The window latch according to claim 19, wherein said housing further includes a finger shoulder.

22. The window latch according to claim 19, wherein said housing further includes a cover.

23. The window latch according to claim 19, wherein said cover is a screw cap.

24. The window latch according to claim 19, wherein said cover is a nameplate.

25. The window latch according to claim 19, wherein said housing further includes a support wall.

26. The window latch according to claim 19, further including a keeper.

27. The window latch according to claim 19, wherein said locking arm further includes an inclined face.

28. The window latch according to claim 27, further including a cam wall.

29. The window latch according to claim 19, wherein said window latch is an offset sweep latch.

30. The window latch according to claim 29, further including a reinforcing shoulder.

31. The window latch according to claim 30, further including a strengthening web between the arms.

32. The window latch according to claim 19, wherein said actuator arm further includes a finger tab.

33. The window latch according to claim 19, wherein said actuator arm further includes a keeper buttress.

34. The window latch according to claim 19, wherein said window latch is a cam latch.

35. The window latch according to claim 19, wherein said window latch is a sweep latch.

36. A window latch for a locking window having a pair of adjacent window sashes when closed, the window latch for coupling to one of the sashes with only one fastener and comprising:

(a) an actuator connected to a locking arm; and (b) a housing at least partially enclosing said locking arm comprising:

(i) an opening for receiving the one fastener aligned with a pivot location at a union of said locking arm and said actuator arm;

(ii) an opening at one side through which the locking arm moves in response to operation of the actuator arm; and (iii) a lip extending downwardly from a bottom of the housing on the one side to reside between the adjacent sashes.

* * * * *